US008122739B1

(12) United States Patent
Jeon

(10) Patent No.: US 8,122,739 B1
(45) Date of Patent: Feb. 28, 2012

(54) EARRING WITH INTEGRAL SPRING

(76) Inventor: Nam W. Jeon, Fairbanks, AK (US)

( * ) Notice: Subject to any disclaimer, the term of this patent is extended or adjusted under 35 U.S.C. 154(b) by 248 days.

(21) Appl. No.: 12/657,124

(22) Filed: Jan. 13, 2010

(51) Int. Cl.
*A44C 7/00* (2006.01)

(52) U.S. Cl. ..... 63/14.7; 63/12; 63/14.1

(58) Field of Classification Search ..... 63/12, 14.1, 63/14.3, 14.7, 3, 5.1, 33, 3.1, 37, 38, 39; 24/522, 523, 524, 525, 527, 528, 135 N, 542, 24/543, 568, 569
See application file for complete search history.

(56) References Cited

U.S. PATENT DOCUMENTS 267,112 A * 11/1882 Sanderson ..... 24/598.2
271,121 A * 1/1883 Riley et al. ..... 63/12
1,057,484 A * 4/1913 Huber ..... 24/135 N
4,907,322 A * 3/1990 Kanno ..... 24/616
5,398,391 A * 3/1995 Yokochi ..... 24/616
5,588,190 A * 12/1996 Sato ..... 24/682.1
6,401,488 B1 * 6/2002 Cousin et al. ..... 63/3
6,928,835 B1 * 8/2005 Cousin et al. ..... 63/39
2009/0013721 A1 * 1/2009 Murao ..... 63/3.1

* cited by examiner

*Primary Examiner* — Jack Lavinder
*Assistant Examiner* — Louis Mercado
(74) *Attorney, Agent, or Firm* — Michael J. Tavella

(57) ABSTRACT

An earring is provided in the form of a spring ring with two mounting members and a bead with lock-screw. The first mounting member is stationary. The second mounting member remains in a normally closed position actuated by a spring. When the earring is in place, the mounting members pinch the auricle to keep the earring in place. Mounting gap is adjusted by the bead and can be locked or unlocked by turning the bead ninety degrees. This earring can be made in different diameters so that it can be worn in any part of the auricle without the ear being pierced.

14 Claims, 4 Drawing Sheets

EARRING WITH INTEGRAL SPRING

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to earrings for use with non-pierced ears and particularly to earrings having an integral spring and spring ring and a secure locking mechanism for use with non-pierced ears.

2. Description of the Prior Art

Earrings that do not require pierced ear typically provide a clamping member pivoted to a platform in such a way as to clamp the lobe of the ear gently between them. These types of clip-on earring are limited to mount an earring to the center of the earlobe.

Another type of earring that can be worn on an unpierced ear is an open loop earring. This type of earring is constructed of resilient material and has two mounting members. The earring is mounted in the earlobe with the two mounting members.

One such open loop type earring is shown in U.S. Pat. No. 4,538,429, titled "Lobe-pinching earring which simulates piercing earring," issued to Bradford on Sep. 3, 1985.

Another such device shown is shown in U.S. Pat. No. 4,704,878, titled "Earring," issued to Saraga on Nov. 10, 1987.

Both inventions are constructed with resilient material in a gapped ring shape so that the gap may be pulled to place the earring in the earlobe. Once the earring is placed in the earlobe, the earring should return to its original closed shape so that it will stay on the earlobe. These inventions rely on the resilience of the material and the geometric shape of the ring to secure the earring in the ear. The disadvantage of these inventions is that provides neither a mechanism to adjust the mounting gap accurately nor a locking device to maintain the secure engagement of the earring.

BRIEF DESCRIPTION OF THE INVENTION

The instant invention includes features to compensate for the disadvantages of the prior art. It is an earring that has a spring ring body, two mounting members and a bead with a lock-screw. The ring is constructed of surgical stainless steel. Mounting members provide an opening for receiving the earlobe and engage opposite sides of the earlobe by the spring force to secure the ring to the earlobe. Because the bead is linked to the movable-mounting member, the mounting gap can be adjusted with the rotating bead. The bead is also used to lock or unlock the mounting gap by pivoting ninety-degrees in either a clockwise or a counter-clockwise direction. This invention makes it possible for wearer to adjust the mounting gap and to lock it for secure engagement.

The spring ring can be made in different diameters so that different sizes of earring can be worn in different parts of the auricle. A small ring can be worn along the edge of the auricle and a large ring can be worn in the interior of the auricle.

It is an objective of the present invention is the provision of a spring ring earring with a secure locking mechanism that can be worn on pierced or un-pierced ears.

DETAILED DESCRIPTION OF THE INVENTION

Figure 1:
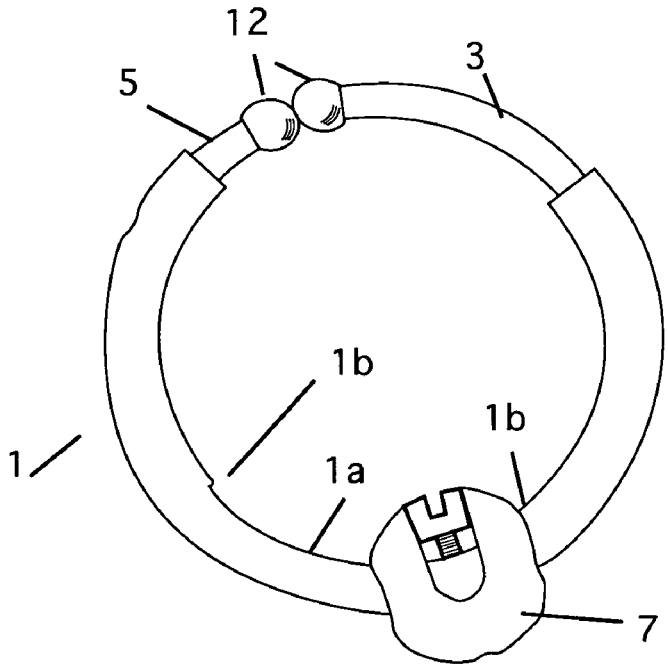
FIG. 1 is a top plan view of the invention in the closed position.
Figure 2:
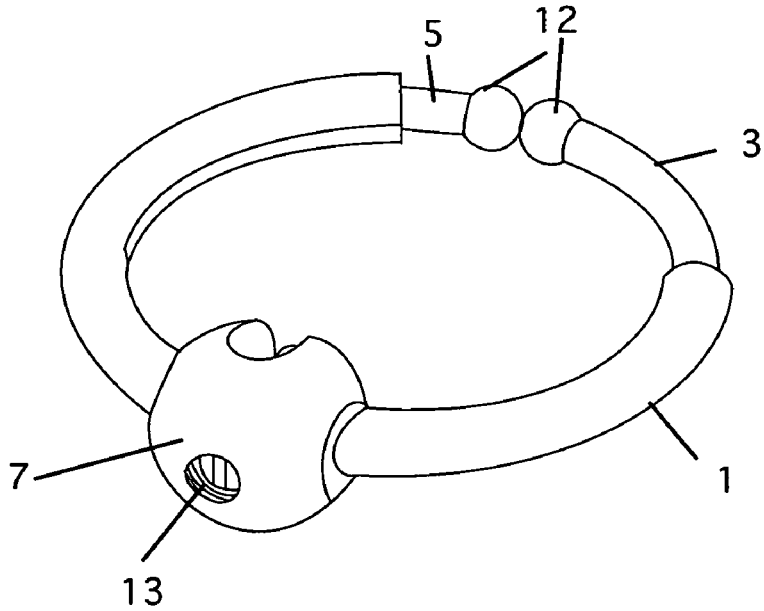
FIG. 2 is a front perspective view of the invention in the closed position.
Figure 3:
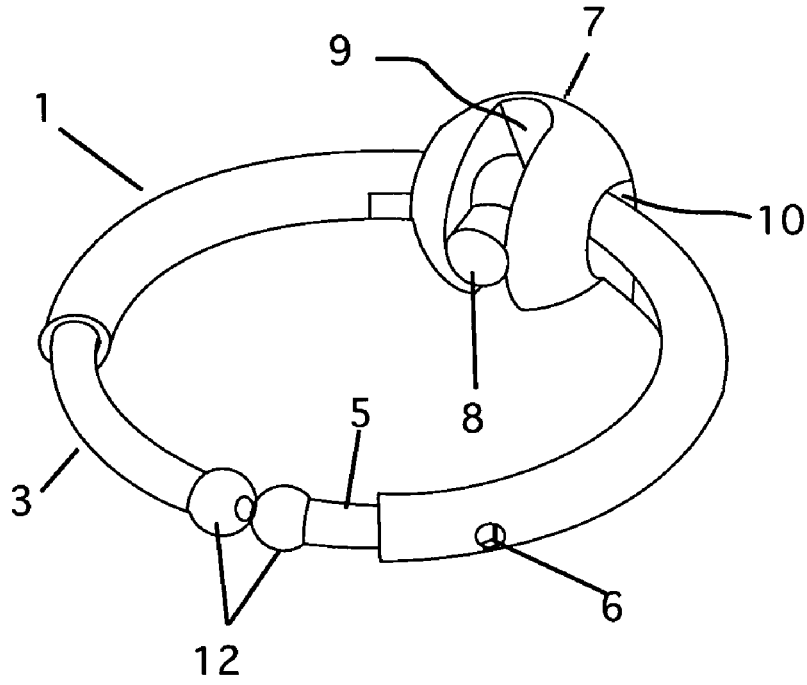
FIG. 3 is a rear perspective view of the invention in the closed position.
Figure 4:
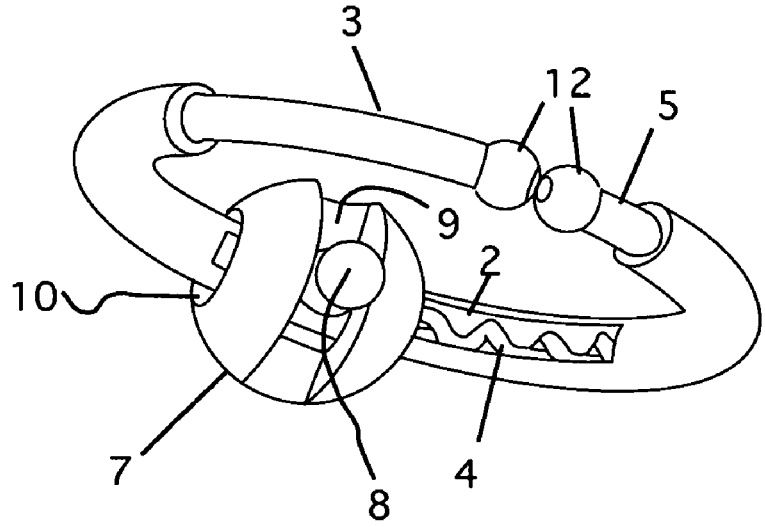
FIG. 4 is a rear perspective view of the invention in the closed position, showing the lower portion of the earring.

Referring now to FIGS. 1-6, the spring ring earring has a body 1 that has a gap 2 formed therein. A sliding mounting member 3 is slidably mounted within the body 1 (see FIG. 5). The sliding member 3 is actuated by a spring 4, as discussed below. A fixed mounting member 5 is installed in the other end of the body 1 as shown. The fixed mounting member is held in place by a setscrew 6 (see, e.g., FIGS. 5, 6). A bead 7 is positioned on the body 1 the operation of the bead 7 is discussed below.

Figure 5:
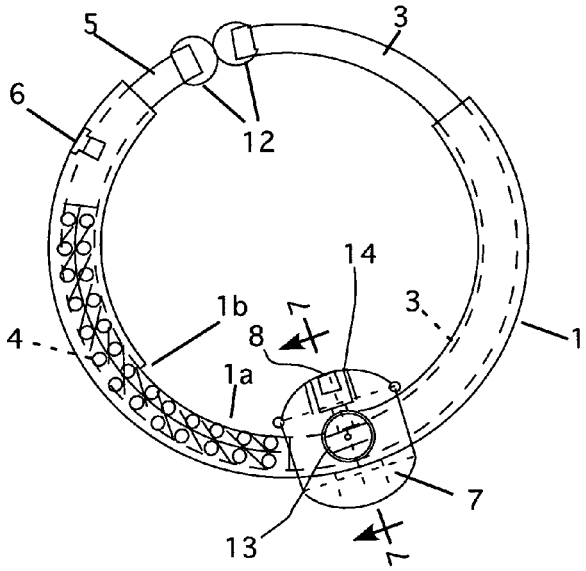
FIG. 5 is a top plan view of the invention in the closed position.
Figure 6:
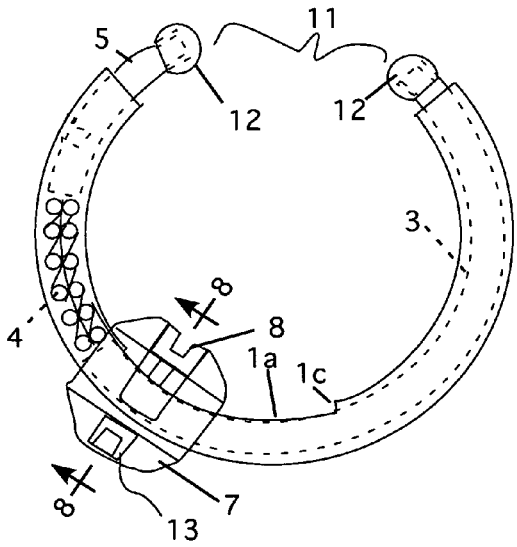
FIG. 6 is a top plan view of the invention in the opened position.

The body 1 is formed of a hollow tube. The inside diameter of the tube is slightly larger than the diameter of the mounting members 3 and 5, so that sliding mounting member 3 can move freely within in the tube. Referring now to FIGS. 1, 5 and 6, the inner circumference of the tube that makes up the body 1 has a cut slot formed in a portion of its inside surface 1*a*. This slot produces a pair of stops 1*b* and 1*c* at the ends of the slot 1*a* (see FIGS. 1 and 5 for 1*b* and FIG. 6 for 1*c*.

Referring now to FIGS. 5-8, one end 3*a* of the sliding mounting member 3 is secured within the bead 7 by a screw 8 through a crosscut groove 9. The center hole 10 of the bead 7 is larger than the outside diameter of the ring tube 1*a* to allow it to slide over the ring body at section 1*a*. Because the bead can slide over the body 1 and because it is attached to the sliding mounting member 3, pulling or pushing of the bead 7 results in opening (FIG. 6) or closing (FIG. 5) of the mounting gap 11.

The cutout slot 2 in the interior rim of the body at section 1*a* provides an opening for screw 8 so that the bead can slide forward and backward.

Each of the ends of the mounting members 3 and 4 that engage an earlobe is capped with a grip ball 12 as shown.

The spring 4 provides pressure on the bead and sliding mounting member, when the sliding mounting member is in the closed position, to close a mounting gap and to maintain engagement with the ear.

Figure 7:
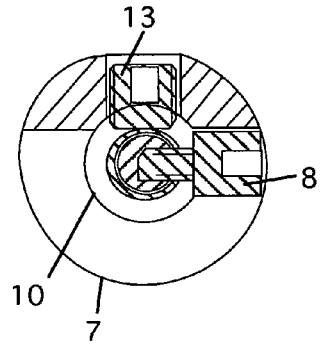
FIG. 7 is a cross-sectional view of the locking bead taken along the lines 7-7 of FIG. 5 showing the bead in the unlocked position.
Figure 8:
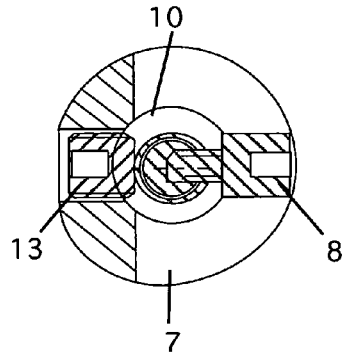
FIG. 8 is a cross-sectional view of the locking bead taken along the lines 8-8 of FIG. 6 showing the bead in the locked position.

To prevent slippage by an accidental pull or push on the bead 7, a locking mechanism is incorporated in the bead. The locking mechanism is best shown in FIGS. 7 and 8. The bead 7 has a lock screw 13 and a second crosscut groove 14 on the upper half of the bead. Because the width of the groove is larger than the diameter of the screw 8, the bead 7 is free to pivot ninety degrees either clockwise or counterclockwise. In this invention, the bead 7 works as a knob to move a sliding-mounting member 3 as well as a locking and unlocking device to control the earring gap.

Figure 10:
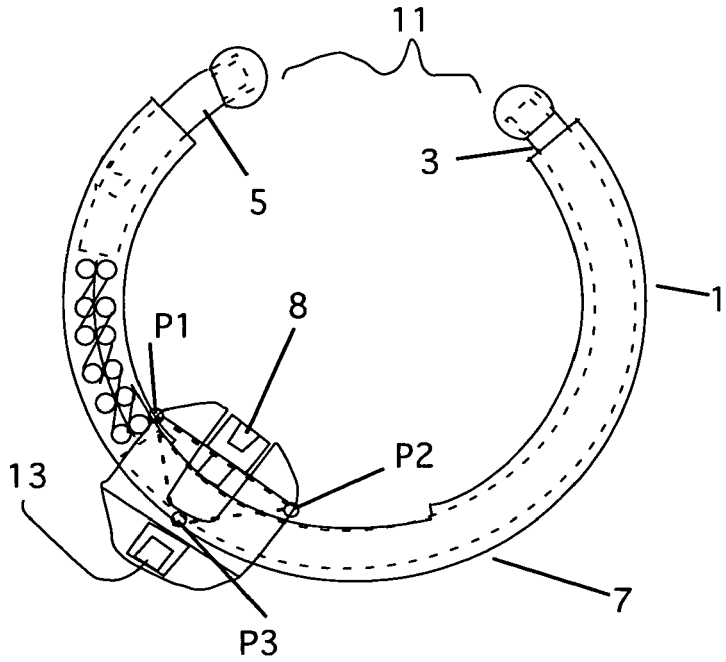
FIG. 10 is a top detail view of the invention showing the relationships of the lock screw and the bead in the unlocked position.

Initially, the tightness of the bead is adjusted by the following procedure. The bead 7 is pivoted so that the lock-screw 13 is aligned with the bottom of the screw 8 in a straight line. See, FIGS. 8 and 10. The lock-screw 13 is tightened down until points P1, P2 and P3 in FIG. 6 establish firm contact with the ring body. The triangular plane created by these points (see FIG. 10) passes through the horizontal centerline of the ring body 1 as shown in FIG. 10. Consequently, tightening the lock-screw 13 causes the bead 7 to grip the ring body 1. This prevents the sliding movement of the bead and puts the bead in locked position.

Figure 9:
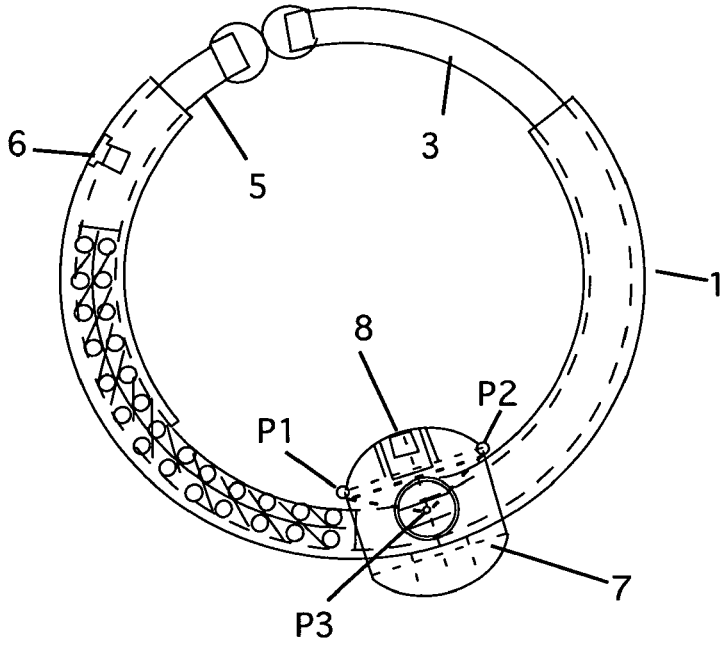
FIG. 9 is a top detail view of the invention showing the relationships of the lock screw and the bead in the locked position.

However, the lock-screw 13 should not be tightened too firmly, so that the bead still can be pivoted to unlock position, e.g., FIG. 7, by a little twisting force with thumb and index finger. In unlocked position the triangular plane created by point P1, P2 and P3 in FIG. 9 does not pass through the horizontal centerline of the ring body 1, as shown in dotted line in FIG. 9, and consequently the bead loses the gripping effect on the ring body.

After initial adjustment of the lock-screw, the bead 7 can be set in the locked or unlocked position simply pivoting it ninety degrees either clockwise or counterclockwise.

To put the earring on, a gap between the grip balls 12 is opened by pulling the bead 7 toward the fixed mounting member 5. The earring is then placed around an earlobe between the grip balls 12. The grip balls 12 are positioned on the spot where wearer wants to wear the earring. The bead 7 is released and the sliding mounting member 3 clamps the earring to the earlobe by spring force. The wearer can adjust the opening gap to a desired comfort level by pushing or pulling the bead. The bead is then pivoted to the locked position as shown in FIG. 8 so that movement of the earring is restricted.

To dismount the earring, the wearer twists the bead 7 to the unlocked position as shown in FIG. 7, pulls the bead 7 to open the gap, and takes the earring off the ear.

In the preferred embodiment of the present invention, a spring ring earring has the following dimensions. The centerline radius of the spring ring is 0.27 inch. The outside diameter of the stainless tubing 1 is 0.063 inch, the inside diameter is 0.046 inch, and the loop opening of the ring body is 0.49 inch. The width of the ring body cutout is 0.024 inch, and the length of the cutout is 0.3 inch from FIG. 10, P4 to FIG. 10, P5. The diameter of the mounting members 3 and 5 is 0.04 inch. The diameter of the grip ball 12 is 0.06 inch. The outside diameter of the stainless bead 7 is 0.2 inch and the diameter of the center hole is 0.05 inch.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An earring comprising:

a) a spring ring having a hollow center;

b) a first mounting member fixed within the hollow center of said spring ring, said first mounting member having a mounting end, and further wherein said mounting end having a mounting ball attached thereto;

c) a second mounting member slidably installed within the hollow center of said spring ring, said second mounting member having a mounting end, and further wherein said mounting end having a mounting ball attached thereto;

d) a spring, operably installed with said hollow center of said spring ring;

e) a bead formed of a solid sphere having a center hole extending longitudinally therethough such that said spring ring passes through said center hole, said bead further having a crosscut groove formed therein, said crosscut groove being positioned perpendicular to the axis of the center hole, said bead having an unlocked position and a locked position;

f) a means for temporarily attaching said bead to said second mounting member; and g) a means for adjustably restricting the movement of the said bead on said spring ring.

2. The earring of claim 1 further comprising a means for adjustably affixing the position of the first mounting member within the center of the spring ring.

3. The earring of claim 2 wherein the means for adjustably affixing the position of the first mounting member comprises a set screw, operably installed in said spring ring such that said set screw impinges upon said first mounting member.

4. The earring of claim 2 wherein the means for attaching said bead to said second mounting member comprise a set screw, mounted in said bead such that said set screw impinges on said second mounting member when said second mounting member is installed in said spring ring and when said set screw is tightened down into said bead.

5. The earring of claim 4 wherein the means for adjustably restricting the movement of the said bead on said spring ring includes:

a) a lock-screw installed in said crosscut groove in said bead.

6. A method of using an earring having a spring ring having a hollow center; a first mounting member fixed within the hollow center of said spring ring, said first mounting member having a mounting end, and further wherein said mounting end having a mounting ball attached thereto; a second mounting member slidably installed within the hollow center of said spring ring, said second mounting member having a mounting end, and further wherein said mounting end having a mounting ball attached thereto; a spring, operably installed with said hollow center of said spring ring; a bead formed of a solid sphere having a center hole extending longitudinally therethough such that said spring ring passes through said center hole, said bead further having a crosscut groove formed therein, said crosscut groove being positioned perpendicular to the axis of the center hole, said bead having an unlocked position and a locked position; a means for temporarily attaching said bead to said second mounting member; an a means for adjustably restricting the movement of the said bead on said spring ring comprising the steps of:

a) unlocking the bead by rotating it into the unlocked position;

b) pushing said bead towards said first mounting member, thereby pulling the second mounting member into said spring ring and compressing said spring;

c) aligning said mounting balls on said first and second mounting members around an ear lobe;

d) releasing said bead, thereby causing said spring to push said second mounting member out of said spring ring to make firm contact with the ear lobe; and e) rotating said bead to the locked position.

7. The method of claim 6 wherein the earring further has a setscrew mounted in said spring ring.

8. The method of claim 7 further comprising the steps of a) adjusting the position of said first mounting member within said spring ring by: i) loosening said setscrew mounted in said spring ring;

ii) moving said first mounting member to a desired location with said spring ring; and iii) tightening said setscrew into said spring ring such that it secures said first mounting member in said spring ring.

9. The method of claim 6 wherein the earring further has a setscrew mounted in said bead.

10. The method of claim 9 further comprising the steps of:

a) securing said bead to said second mounting member within said spring ring by: i) loosening said setscrew mounted in said bead;

ii) moving said second mounting member to a desired location with said spring ring and said bead; and iii) tightening said setscrew into said bead such that it secures said second mounting member to said bead.

11. The method of claim 10 wherein the earring further has a lock-screw installed in said crosscut groove in said bead.

12. The method of claim 11 further comprising the steps of adjusting said locking mechanism by tightening said lock screw to a desired pressure level.

13. The method of claim 12 further comprising the steps of locking said bead by:

a) rotating said bead about said spring ring until said locking screw is in horizontal alignment with said setscrew in said bead.

14. The method of claim 12 further comprising the steps of locking said bead by:

a) rotating said bead about said spring ring until said locking screw is in orthogonal alignment with said setscrew in said bead.

* * * * *